US005156288A

United States Patent [19]

Levy

[11] Patent Number: 5,156,288

[45] Date of Patent: Oct. 20, 1992

[54] FOLDABLE CRATES

[76] Inventor: Uri Levy, Harakefet 9, Holon, Israel

[21] Appl. No.: 732,629

[22] Filed: Jul. 19, 1991

[51] Int. Cl.[5] ..... B65D 19/10

[52] U.S. Cl. ..... 220/4.29; 220/6; 206/509

[58] Field of Search ..... 220/6, 4.29, 7; 206/509

[56] References Cited

U.S. PATENT DOCUMENTS

| | | | |
|---|---|---|---|
| 4,181,236 | 1/1980 | Prodel | 220/4.29 |
| 4,347,941 | 9/1982 | Johansson et al. | 220/4.29 |
| 4,491,231 | 1/1985 | Heggeland et al. | 220/6 |
| 4,591,065 | 5/1986 | Foy | 220/6 |
| 4,820,383 | 4/1989 | Shchamorov et al. | 220/6 |
| 4,834,254 | 5/1989 | Mead | 220/6 |

FOREIGN PATENT DOCUMENTS 2814844 10/1979 Fed. Rep. of Germany ..... 220/4.29

*Primary Examiner*—Joseph Man-Fu Moy
*Attorney, Agent, or Firm*—Bernard Malina

[57] ABSTRACT

The present invention relates to an improved foldable crate designed to be interchangeably stacked together with solid one-piece crates. The crate has four side walls hinged to each other so that in the folded state of the crate, one pair of side walls become compacted against the other pair in a face-to-face position. Each side wall has a flat top rim, and a bottom rim provided with a series of cantilever support elements integrally formed therewith, projecting into the hollow of the crate and adapted to support the bottom wall of the crate. At least one of the supports of each side wall comprises a depending stop portion underlying and integrally formed with a bottom end-portion of the respective cantilever support elements.

7 Claims, 9 Drawing Sheets

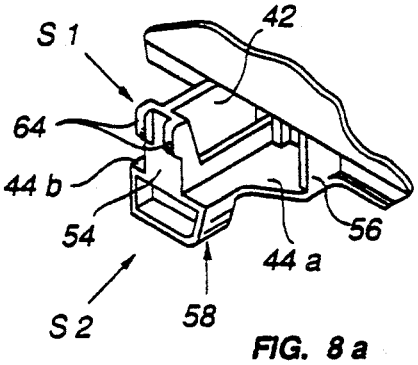
FIG. 8 a
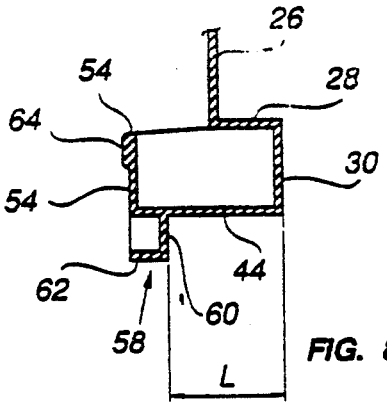
FIG. 8 b
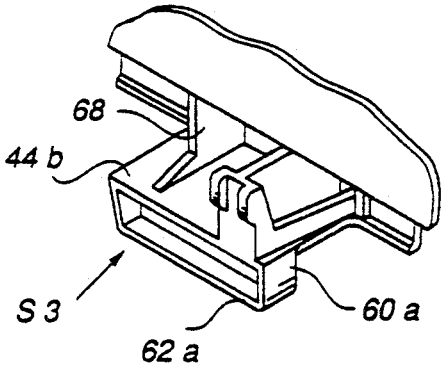
FIG. 9 a
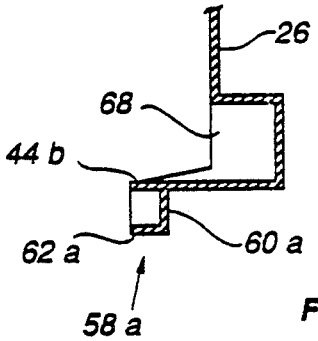
FIG. 9 b
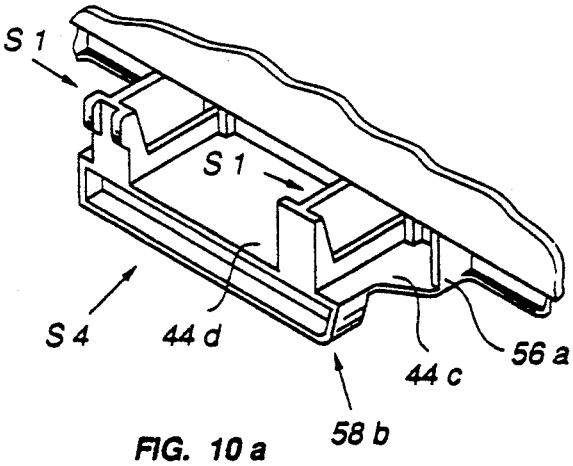
FIG. 10 a
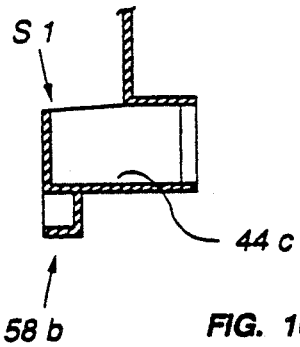
FIG. 10 b
FIG. 11 a
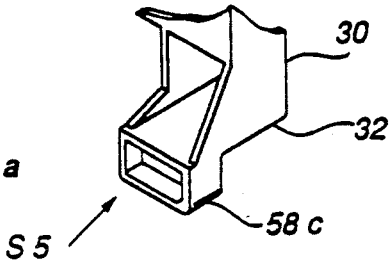
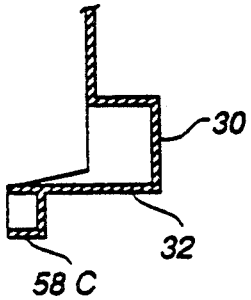
FIG. 11 b

FOLDABLE CRATES

BACKGROUND OF THE INVENTION

The present invention concerns crates for the transport of goods such as agricutural products, bottles and the like, and more particularly to crates provided with mutual interlocking means to safeguard against lateral sliding of one layer of crates relative to an underlying or overlying layer when the crates are piled in superimposed positions.

Piling of crates may be either in a fully overlapping relative position whereby the bottom of one overlying crate rests on, and is received by, the upper rim of an underlying crate, or in a partly overlapping fashion known in the art as "bonded brick-stacking".

In general, crates fall into two main categories, namely: solid crates and foldable crates. There have been accordingly developed over the years a large variety of separate solutions to satisfy the specific requirement posed by each of these categories—see, for example—U.S. Pat. No. 3,568,879 and U.K. Pat. No. 1,409,046 relating to solid crates, and U.S. Pat. No. 4,491,231 and Israel Design No. 12697 relating to foldable crates.

The problems, on the one hand, of stacking one-piece, integral crates, and on the other hand, of stacking foldable crates, have thus been more or less satisfactorily solved. However, due to their different design considerations, and resulting construction, attempts have hitherto not been made to adapt the two types of crates so that, as far as stacking is concerned, they would be compatible with each other. In other words, one is, at present, restricted to using one type of crate only and should one wish to use the other type of crate, it would have to be willing to undergo the expense and inconvenience of switching over to the other type of crate and to scrapping its existing stock of crates.

The solution to this problem is considerably more difficult than it appears at first sight, if one regards as a prerequisite the interlocking of the crates being secured by a suitable design applied to the bottom side only thereof - rather than in combination with the upper rim of the crate. This is due to the fact that the bottom wall of the foldable crate is separable from the four sides, being seated only by friction such that it inherently cannot bear any upwardly applied forces.

SUMMARY OF THE INVENTION

It is an object of the present invention to provide a foldable crate which is capable of being stacked together with one-piece crates in a convenient manner.

Another object of the present invention is to provide a foldable crate which is capable of being stacked in an overlapping configuration and also in a bonded brick-stacking configuration.

Another object of the present invention is to provide a foldable crate which has sufficient mechanical strength to enable safe and efficient stacking.

Another object of the present invention is to provide a foldable crate which is capable of being manufactured using high volume injection molding techniques.

Still another object of the present invention is to provide a foldable crate which is capable of being folded in an efficient and space-saving manner.

In accordance with the present invention there is provided a foldable crate having four side walls and a separable bottom wall. The side walls are hinged to each other so that in the folded state of the crate, one pair of side walls becomes compacted against the other pair in a face-to-face position. Each side wall has a flat top rim, and a bottom rim provided with a series of cantilever support elements integrally formed therewith, projecting into the hollow of the crate and adapted to support the bottom wall of the crate. At least one of the supports of each side wall comprises a depending stop portion underlying and integrally formed with a bottom end-portion of the respective cantilever support elements. The cross-section of the support elements at any given point therealong is T-shaped, both in a plane parallel to the respective side wall and in a plane parallel to the bottom wall.

BRIEF DESCRIPTION OF THE DRAWINGS

Additional details of construction and advantages of the invention will become more fully understood in the light of the ensuing description of a preferred embodiment thereof, given by way of example only, with reference to the accompanying drawings, wherein:

FIG. 8*a* is a three-dimensional view of a first modified version of a cantilever support element;

FIG. 8*b* is a longitudinal cross-section of the support element of FIG. 8*a;*

FIG. 9*a* is a three-dimensional view of a second modified version of a cantilever support element;

FIG. 9*b* is a longitudinal cross-section of the support element of FIG. 9*a;*

FIG. 10*a* is a three-dimensional view of a third modified version of a cantilever support element;

FIG. 10*b* is a longitudinal cross-section of the support element of FIG. 10*a;*

FIG. 11*a* is a three-dimensional view of a fourth modified version of a cantilever support element;

FIG. 11*b* is a longitudinal cross-section of the support element of FIG. 11*a;*

DETAILED DESCRIPTION OF THE PREFERRED EMBODIMENTS

Figure 1:
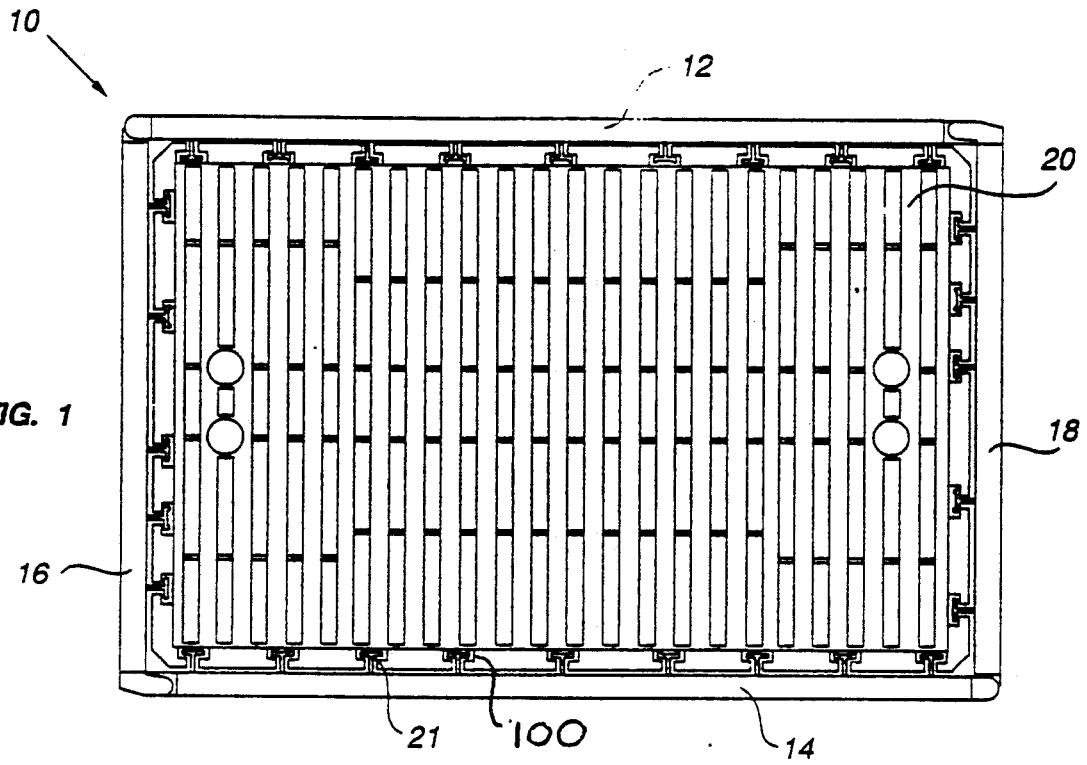
FIG. 1 is a top view of a foldable crate made in accordance with the present invention.
Figure 2:
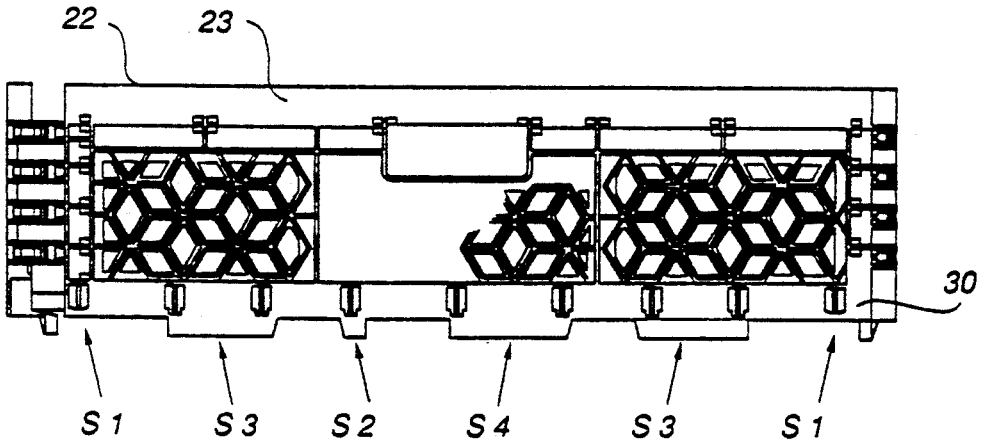
FIG. 2 is a first side view of the crate of FIG. 1.
Figure 15A:
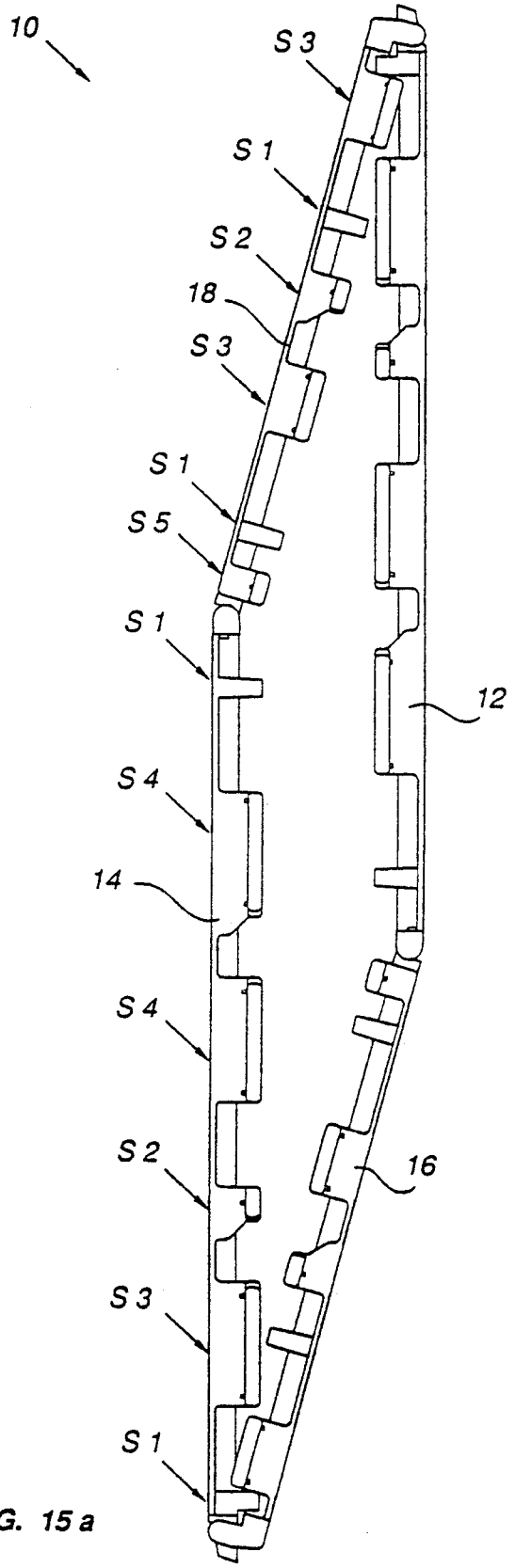
FIGS. 15*a* and 15*b* show stages of folding the crate according to the present invention for purposes of storage.
Figure 15B:
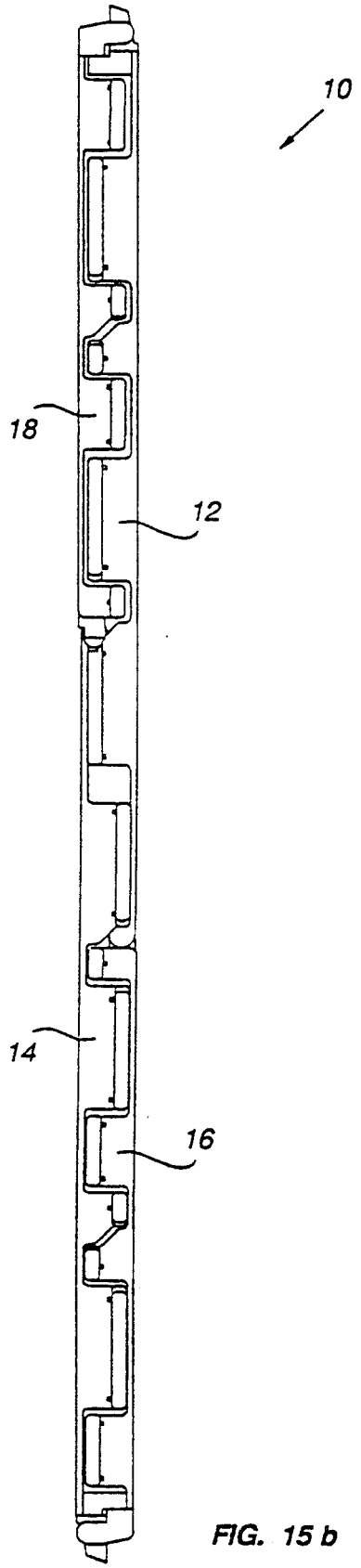

Referring to FIG. 1 of the drawings, there is shown a foldable crate generally denoted by the numeral 10 which comprises first and second long side walls 12 and 14, first and second short side walls 16 and 18, and a dismantable or removeable bottom wall 20. The side walls are hinged to each other in a conventional manner so that when the bottom wall 20 is removed, the four side walls may be folded together into a flat elongated package, as illustrated in FIGS. 15*a* and 15*b*. The bottom wall 20 is supported all along its edges by a plurality of cantilever supporting elements 21.

The invention is directed toward the construction of the support elements 21 since, as will be explained in more detail below, these support elements 21 are essential in effectively achieving the goals of the invention, namely, to assure sufficient mechanical strength for supporting a loaded bottom wall of the foldable crate; to allow the hybrid stacking of foldable as well as solid crates and to allow such stacking in either overlapping or in the bonded brick-stacking fashion—(see FIG. 14); and to enable the basic design of the elements to be easily extended or changed into different shapes and configurations at minimum cost.

Referring now to FIGS. 2 to 6, it will be seen that the side walls are essentially of the same design, namely a U-shaped top portion comprising flat top rim 22, web 23 and rib 24, a main wall portion 26 which may carry a lattice work pattern for the purpose of saving on material and weight of the crate as a whole, and a lower, substantially U-shaped bottom portion, comprising leg 28, web 30, bottom leg 32 and a plurality of stacking support elements denoted by the letter S. The stacking support elements are described in more detail below.

It should be noted that the flat upper rim 22 is mandatory so as to enable the folding crate to be compatible with the standard solid crate construction for the purpose of stacking solid and foldable crates 10 together.

Taking now a closer look at the various support elements deployed along the bottom of the various side walls 12, 14, 16, 18, it will be seen that they all fall into several groups of similar design, namely: with respect to the long side walls 12, 14 (FIGS. 2 and 5), there are the basic support elements denoted S1, located at the two extreme sides of the wall; one support element denoted S2; two support elements denoted S3; and one support element denoted S4.

Figure 3:
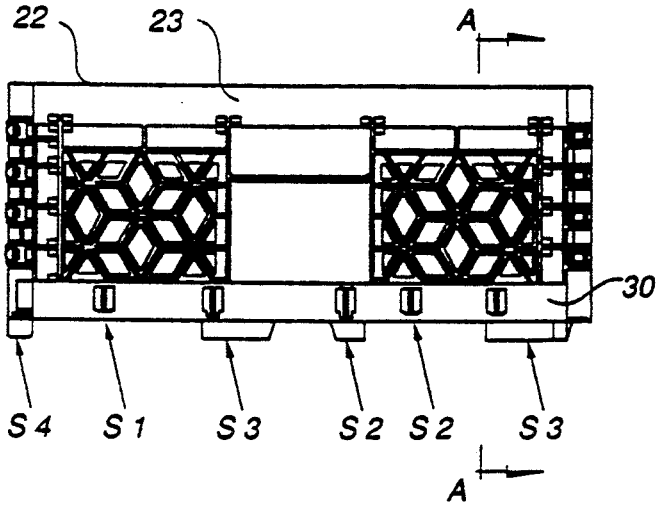
FIG. 3 is a second side view of the crate of FIG. 1.
Figure 4:
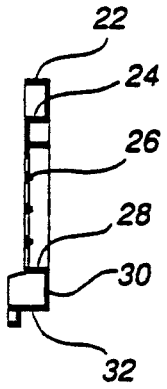
FIG. 4 is a section taken along line A—A of FIG. 3.
Figure 5:
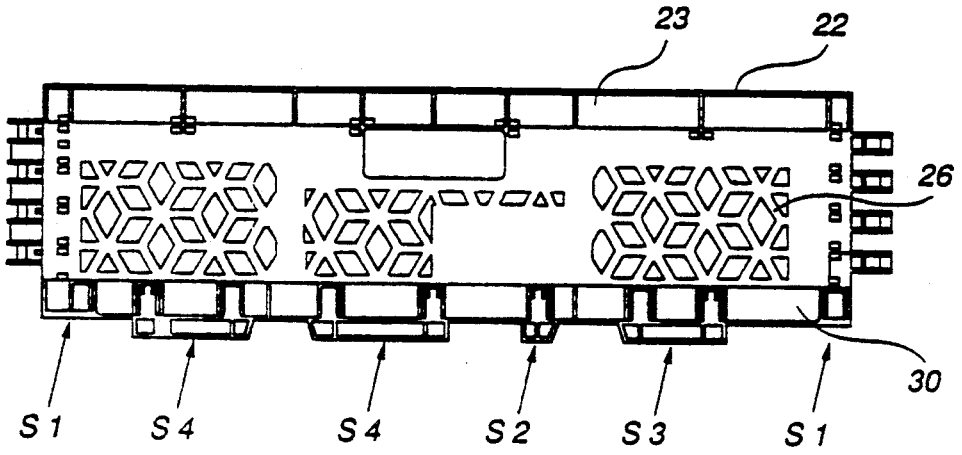
FIG. 5 is a elevation of the inner side of the long side wall of the crate shown in FIG. 2.
Figure 6:
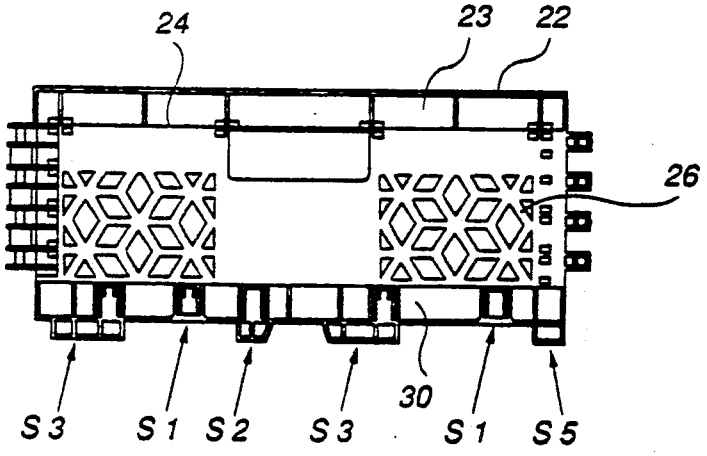
FIG. 6 is an elevation of the inner side of the short side wall of the crate shown in FIG. 3.

It will be readily seen that identical support elements are comprised in the short side walls 16, 18 as shown in FIGS. 3 and 6. In addition, the short side walls 16, 18 also include a fifth type of support element denoted S5.

The constructional features of the basic support element S1 are best seen in FIGS. 7*a*–7*e*. Emerging from an opening 40, formed in the web 30 of the lower side wall bottom portion, is an upright rib 42 partly molded together with the leg 28. At its bottom the rib 42 emerges from a flat floor plate 44 which carries a pair of delimiting shallow ribs 46 and 48. Ribs 46 and 48 taper upwards into ribs 50 and 52 respectively. An end rib 54 closes this structure and forms the complete T-shaped cantilever support.

Figure 7A:
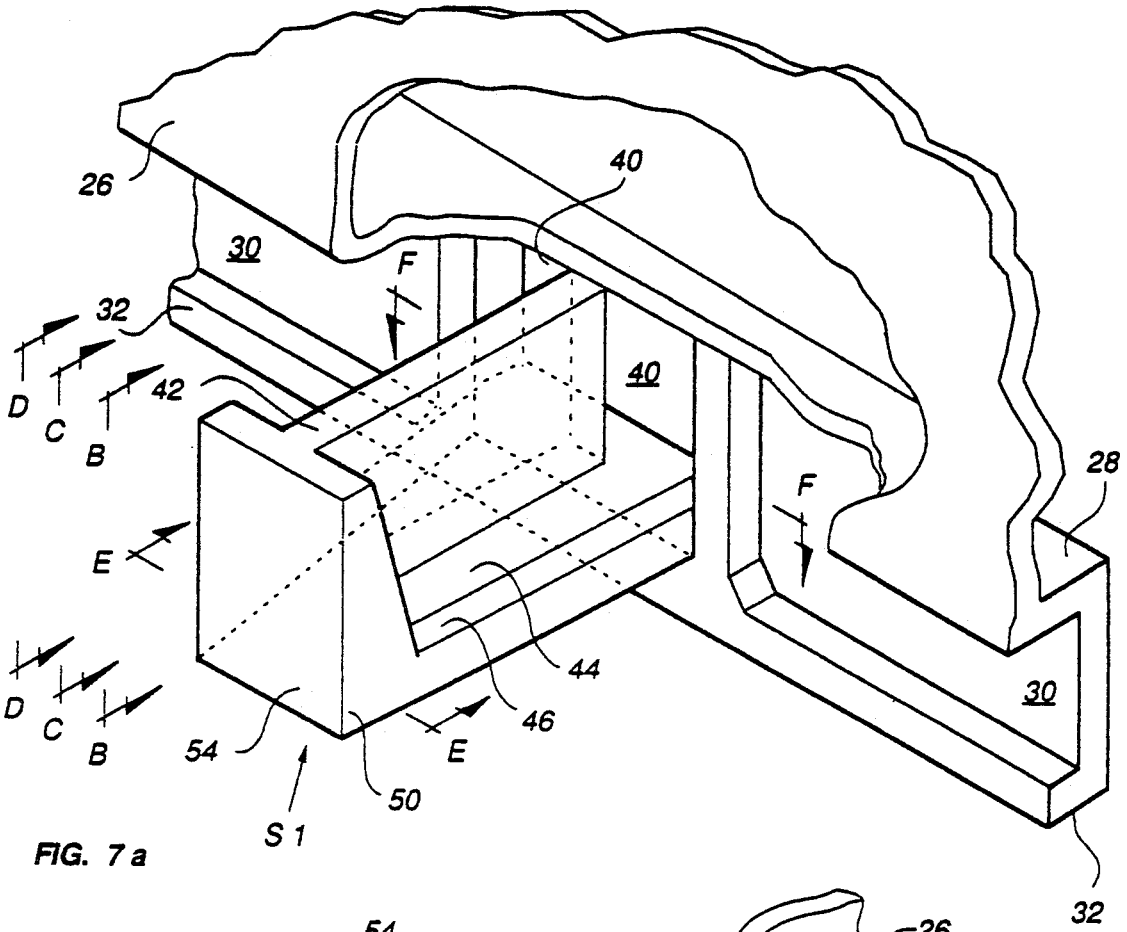
FIG. 7*a* is a front, three-dimensional view, of a basic cantilever support element employed in the side walls of the crate.
Figure 7B:
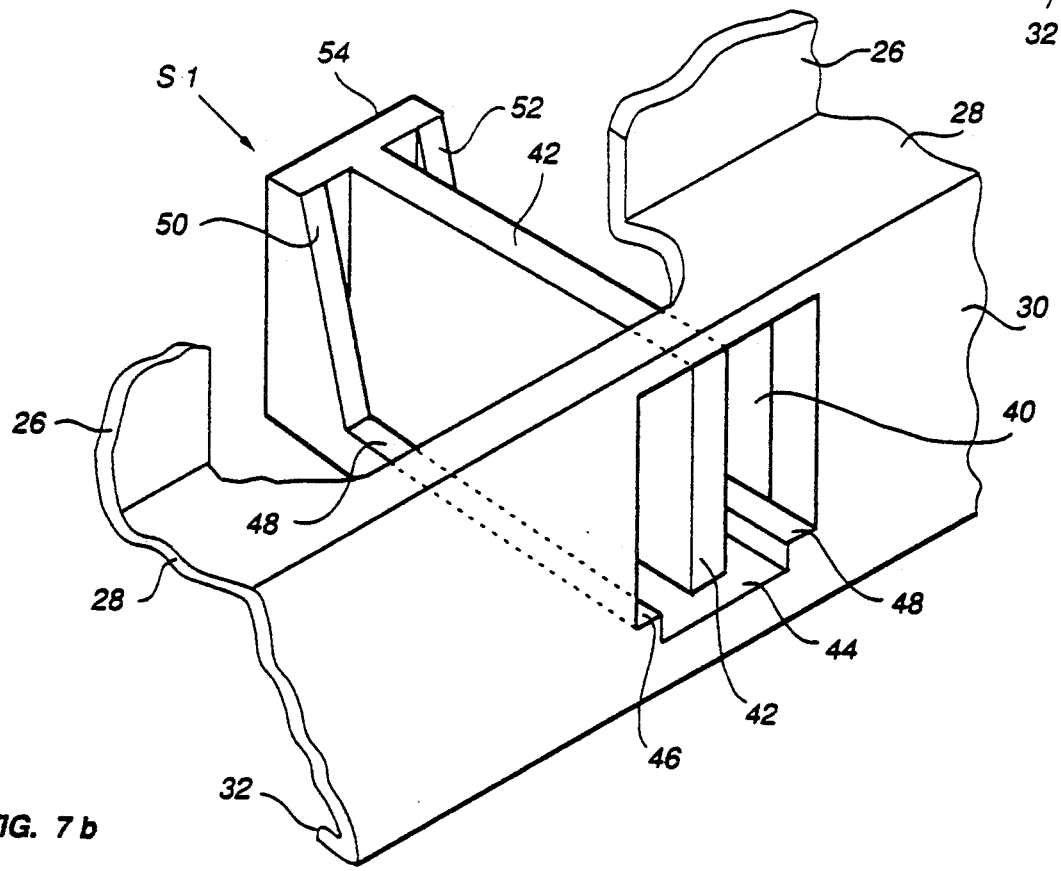
FIG. 7*b* is a rear, three-dimensional view of the cantilever support element of FIG. 7*a;*
Figure 7C:
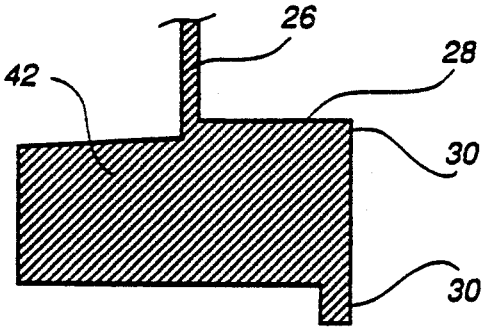
FIG. 7*c* is a section taken along line B—B of FIG. 7*a;*
Figure 7D:
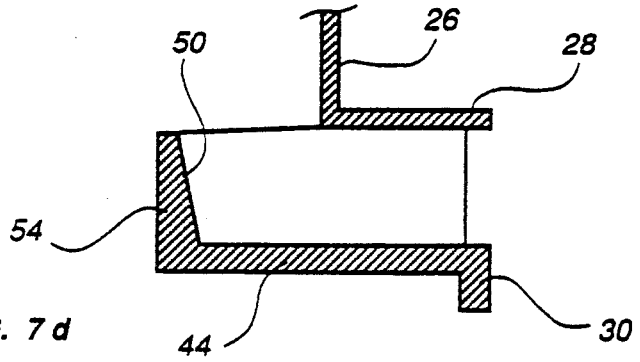
FIG. 7*d* is a section taken along line C—C of FIG. 7*a;*
Figure 7E:
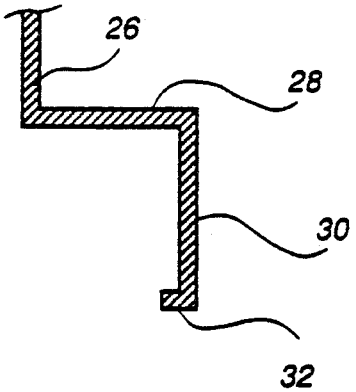
FIG. 7*e* is a section taken along line D—D of FIG. 7*a;*
Figure 7F:
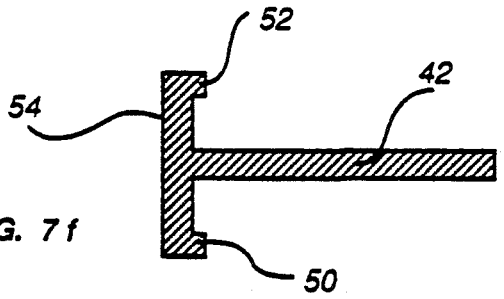
FIG. 7*f* is a section taken along line E—E of FIG. 7*a;*
Figure 7G:
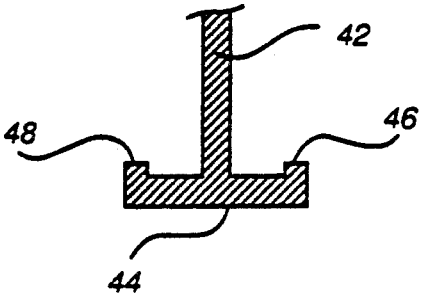
FIG. 7*g* is a section taken along line F—F of FIG. 7*a;*

Cross-sections taken along the profile of element S1 are shown in FIGS. 7*f* and 7*g*. In both horizontal and vertical planes, the cross-section is T-shaped.

This basic configuration of the cantilever support element S1 is further developed into the modified support elements S2 (FIGS. 8*a*, 8*b*), S3 (FIGS. 9*a*, 9*b*), S4 (FIGS. 10*a*, 10*b*) and S5 (FIGS. 11*a*, 11*b*).

Referring to FIGS. 8*a*–8*b*, there is depicted the first modification S2 of the basic element S1. The bottom plate or floor 44 is extended at both sides as denoted 44*a* and 44*b*. The portion 44*a* is further strengthened by an upright rib 56. Projecting downwards is a stop portion denoted 58 defining a stop wall 60, with bottom leg 62, distanced from the side wall portion 30 by length L which equals the width of the top rim 22 (see FIG. 4).

A pair of friction bulges 64 may be formed at both sides of the end rib 54. The bottom leg 62 is provided so as to ensure that the bottom wall 20 (which is supported by its supporting elements 21) of the lowest crate in the pile remains above the lowest point of the pile.

In a further development of the support elements, denoted S3, depicted in FIGS. 9*a* and 9*b*, the stop portion 58*a* is of greater length than the stop portion (58) in S2, with the horizontal rib 44*b* strengthened by an upright rib 68.

A further modification of the support member is shown in FIGS. 10*a* and 10*b* namely, the support element S4. It comprises a pair of basic supports S1, and a stop portion denoted 58*b* (which is longer than both the stop portions 58 and 58*a* in S2 and S3, respectively), emerging from the bottom surface of an extended floor rib 44*d*.

For constructional reasons a fifth kind of support is provided and denoted S5 shown in FIGS. 11*a* and 11*b* characterized in that it does not include the T-shaped cantilever support element common to the other support elements (S1, S2, S3 and S4), but only includes a stop portion denoted 58*c*.

In use, each of the support members S1, S2, S3, S4, S5 engages an appropriately shaped aperture 100 formed in the bottom wall 20, as is shown in FIG. 1.

Those skilled in the art of plastic molding will readily appreciate that employing a basic unit configuration such as for the support member S1 and only making minor modifications, to the extent dictated by additional design considerations, significantly decreases the costs of the molding die.

Figure 12A:
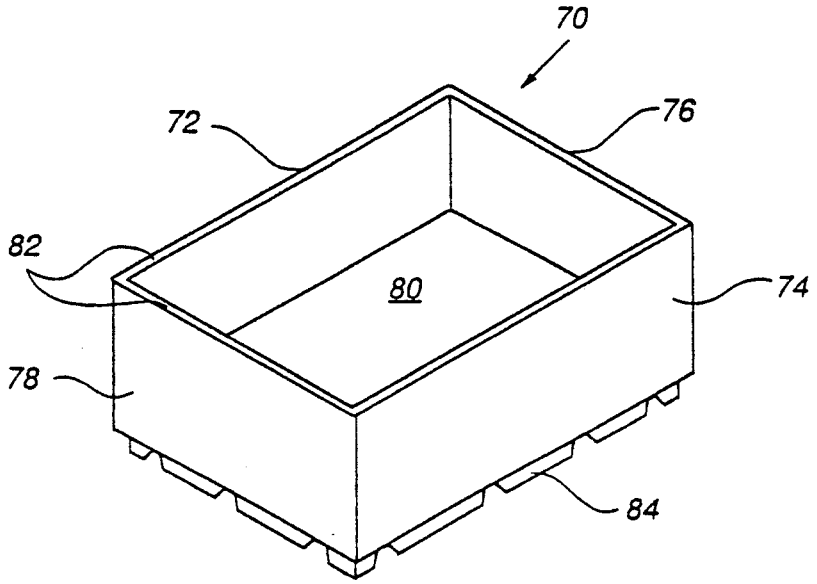
FIG. 12*a* and 12*b* are respectively, top and bottom three-dimensional views of a conventional, solid crate.
Figure 12B:
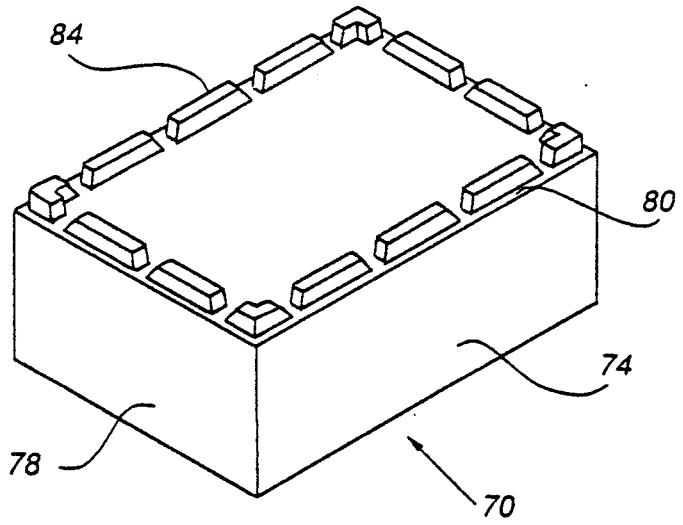

Referring now to FIGS. 12*a* and 12*b*, a standard, nonfoldable, solid crate 70 is shown, comprising two long side walls 72 and 74, two short side walls 76 and 78, and a bottom wall 80. The upper rim 82 of the crate is plain. The bottom 80 is provided with a rectangular projecting rib 84 dimensioned so as to allow for the safe stacking of these crates one on top of the other.

Figure 14:
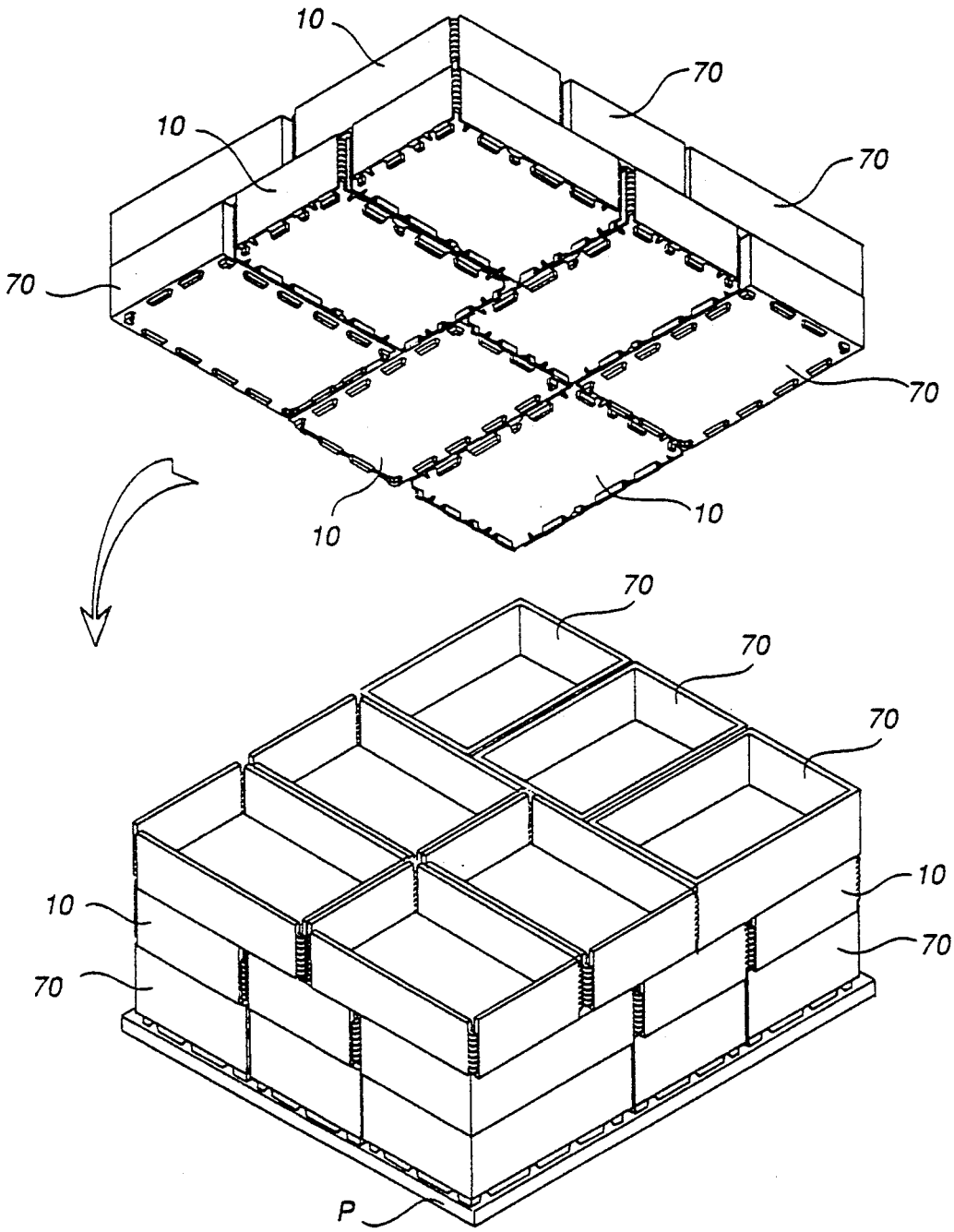
FIG. 14 illustrates the piling of solid and foldable crates in a brick-stacking fashion.

Furthermore, the rib 84 may be divided into several sections in order to allow for stacking the crates in the known brick-stacking manner (see FIG. 14).

The division of the rib 84 into a plurality of sections is also clearly shown in FIGS. 12*a* and 12*b*. This division of the rib 84 into a plurality of section facilitates the interlocking of the ribs 84 with upper rim 84 of a lower layer of cases 10 as is shown in FIG. 14, resulting in a safe and efficient stacking arrangement.

Figure 13:
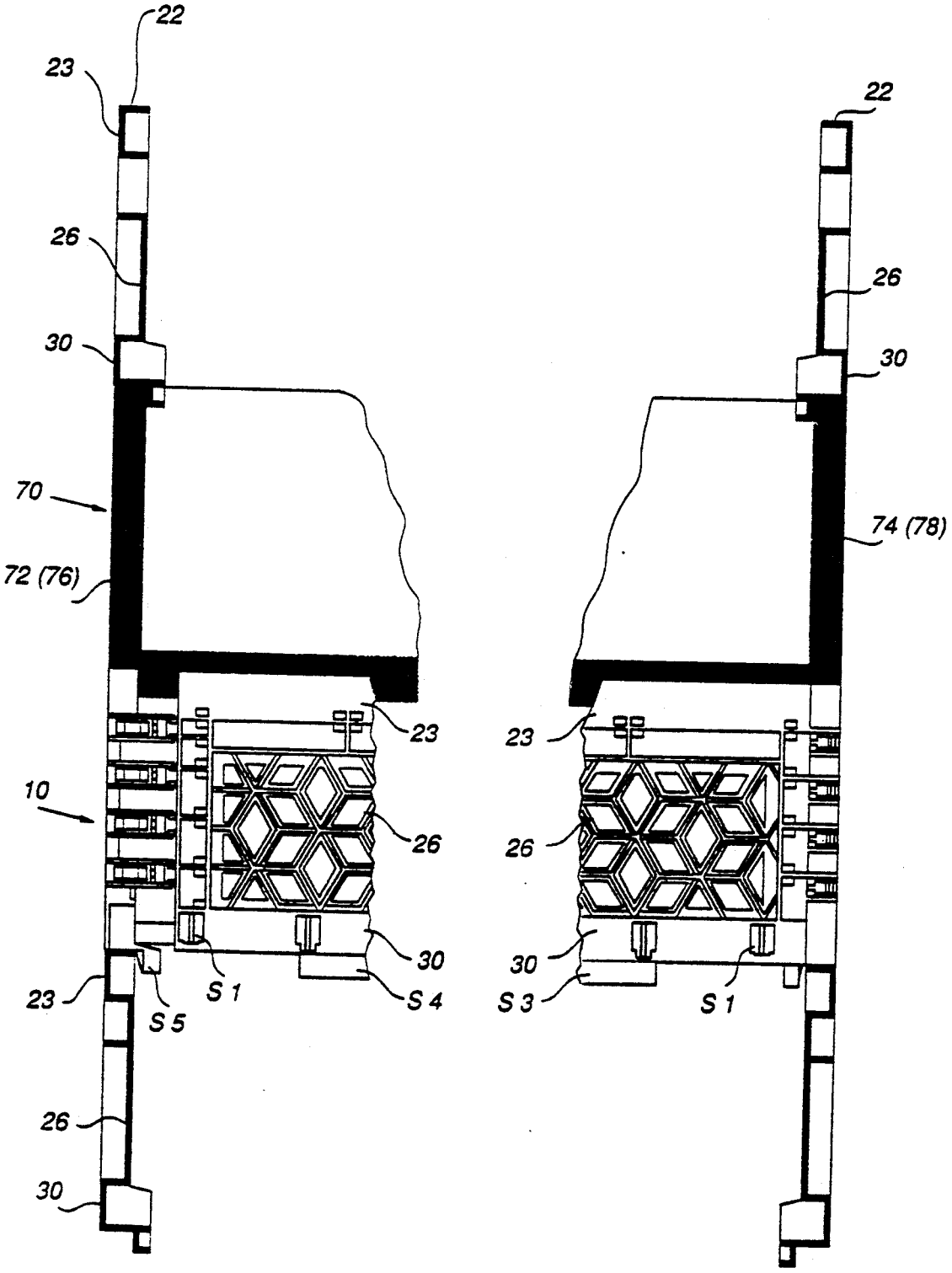
FIG. 13 illustrates the piling of solid and foldable crates in an overlapping fashion.

FIG. 13 thus clearly illustrates the interchangeability of the standard crates 70 with the foldable crates 10, proposed according to the present invention, in an overlapping stacking arrangement. FIG. 14 further illustrates the interchangeability of both types of crates but in a brick-stacking arrangement (placed for transportion on a pallet P) which is made possible by the design of the various support elements S1, S2, S3, S4 and S5 of the proposed foldable crates, which match the standard design of the bottom rib 84 of the solid crates.

FIGS. 15*a* and 15*b* illustrate the manner of folding the crate 10 into a compact storage position and need not be further elaborated upon, other than to note that supports S1, being at a higher horizontal level than supports S3 and S4, fit in above and behind supports S3 and S4, as shown, and to note that the various supports S1 interengage in the storage position (FIG. 15*b*) to form a compact configuration.

It has thus been established that by providing the foldable crates with a series of projections designed according to the principles of the present invention, the objects of the invention as heretofore outlined are satisfactorily reached.

Those skilled in the art will readily appreciate that various changes, modifications and variations may be applied to the invention as heretofore exemplified, without departing from the spirit and scope thereof, as defined in and by the appended claims.

What is claimed is:

1. A foldable crate having four side walls and a separable bottom wall, the sidewalls being hinged to each other so that in a folded state of the crate one pair of side walls becomes compacted against a second pair in a face-to-face position, each side wall having a flat top rim, and a bottom rim provided with a series of cantilever support elements integrally formed therewith, projecting into a hollow of the crate and adapted to support the bottom wall of the crate, at least one of the cantilever support elements of each side wall comprising a depending stop portion underlying and integrally formed with a bottom end portion of the respective cantilever support element, the stop portion being projectable into a hollow of a further underlying crate.

2. A foldable crate according to claim 1 wherein the cantilever support element is configured so that a cross section thereof at any given point therealong is T-shaped both in a plane parallel to the respective side wall and in a plane parallel to the bottom wall.

3. A foldable crate according to claim 2 wherein the cantilever support element emerges from an opening in the bottom wall portion.

4. A foldable crate according to claim 3 wherein the bottom wall portion is U-shaped.

5. A foldable crate according to claim 3 further comprising a rest portion extending in a plane parallel to the bottom wall of the crate.

6. A foldable crate according to claim 1 wherein a pair of said cantilever support elements are combined into a unitary body.

7. A foldable crate according to claim 1 wherein the stop portion has a wall in perpendicular relationship to the cantilever support element.

* * * * *